United States Patent [19]

Clement

[11] Patent Number: 4,928,357

[45] Date of Patent: May 29, 1990

[54] LAP GUIDE ARRANGEMENT FOR A COMBING MACHINE

[75] Inventor: Heinz Clement, Winterthur, Switzerland

[73] Assignee: Rieter Machine Works, Ltd., Winterthur, Switzerland

[21] Appl. No.: 333,459

[22] Filed: Apr. 5, 1989

[30] Foreign Application Priority Data

Apr. 19, 1988 [CH] Switzerland ..... 01425/88

[51] Int. Cl.[5] ..... D01G 19/16

[52] U.S. Cl. ..... 19/225; 19/227; 19/235

[58] Field of Search ..... 19/115 R, 223, 225, 19/226, 227, 228, 235

[56] References Cited

U.S. PATENT DOCUMENTS 1,087,780 2/1914 Keeley ..... 19/225

3,320,633 5/1967 Katori ..... 19/229

FOREIGN PATENT DOCUMENTS 0868865 3/1953 Fed. Rep. of Germany .

20791 of 1897 United Kingdom .

18130 of 1909 United Kingdom .

1414578 11/1975 United Kingdom .

*Primary Examiner*—Werner H. Schroeder

*Assistant Examiner*—Michael A. Neas

*Attorney, Agent, or Firm*—Kenyon & Kenyon

[57] ABSTRACT

The lap guide arrangements employs a pair of guide plates for guiding the lap from the lap roller to the feed roller on the nipper. The two guide plates are connected by a strip of flexible material which permits pivoting of the plates relative to each other. The strip of flexible material is made of a high tensile strength so as to accommodate a high nip number, for example, from 300 to 350 per minute.

20 Claims, 2 Drawing Sheets

LAP GUIDE ARRANGEMENT FOR A COMBING MACHINE

This invention relates to a lap guide arrangement for a combing machine.

As is known, various types of guide arrangements have been used in combing machines for guiding a lap between a lap roller and a feed roller mounted in a pivoting nipper. In some cases, the guide arrangement has been formed by two pivotally connected guide plates, a first one of which is pivotally connected to an element fixed at the lap roller, while the second is pivotally connected to an element which is disposed at the feed roller and pivots with the nipper.

The purpose of the two pivotally connected guide plates is to maintain the length of travel for the lap unwound from the lap roller and resting on the plates substantially constant—despite the fact that the distance between the lap roller and the feed roller varies due to the nipper movement— and to obviate any fluttering and distortion of the lap.

In known guide arrangements of the type indicated, the two guide plates are pivotally connected by a hinge with pivot pins. However, in practice, particularly with the high working speeds or nip numbers required today, hinge bearings have been found to deflect after a relatively short period of operation, resulting in excessive play and excessive noise.

Other guide arrangements which have been previously known are described in U.S. Pat. No. 3,320,643 which describes hingedly mounted guide elements as well as in British patent 18,130, German patent 868,865 and British patent 1,414,578 which describe guide arrangements employing plates for guiding a lap between a lap roller and a comb.

Accordingly, it is an object of the invention to provide a lap guide arrangement of relatively long life.

It is another object of the invention to provide a lap guide arrangement capable of high speed operation.

It is another object of the invention to provide a lap guide arrangement for use with nip numbers of 300 to 350 per minute.

Briefly, the invention provides a lap guide arrangement for a combing machine comprising a pair of guide plates and at least one strip of flexible material fixed to and between the plates to permit pivoting of the plates relative to each other. In addition, one guide plate is provided with means at one end for mounting on a frame adjacent a lap roller while the other guide plate is provided with means at the opposite end for mounting on a reciprocal nipper adjacent a feed roll.

The strip preferably consists of an industrial filament fabric of the kind used, for example, for driving belts. A fabric of this kind has a high tensile strength, and can thereore be relatively thin, e.g. about 1 millimeter (mm), and hence guarantee high flexibility of the connection between the two guide plates. However, the distance between the adjacent edges of the guide plates should not be excessive and may advantageously be about 2 to 3 millimeters (mm).

The pivotal connection provided by the strip of flexible material between the two guide plates not only has an increased life but also requires no lubrication and cannot cause any noise.

The means at the end of the first guide plate for mounting on the frame adjacent the lap roller includes a member which is snap fitted onto a shaft fixedly mounted on the frame. In like manner, the means for mounting the second guide plate in the nipper includes a member which can be snap fitted onto a shaft fixedly mounted on the nipper. In this case, the guide plates can be easily released from a combing machine without the use of tools.

Alternatively, the coupling of the guide plates to the frame adjacent the lap roller and to the nipper may be formed by a strip of flexible material.

These and other objects and advantages of the invention will become more apparent from the following detailed description taken in conjunction with the accompany drawings wherein.

Figure 1:
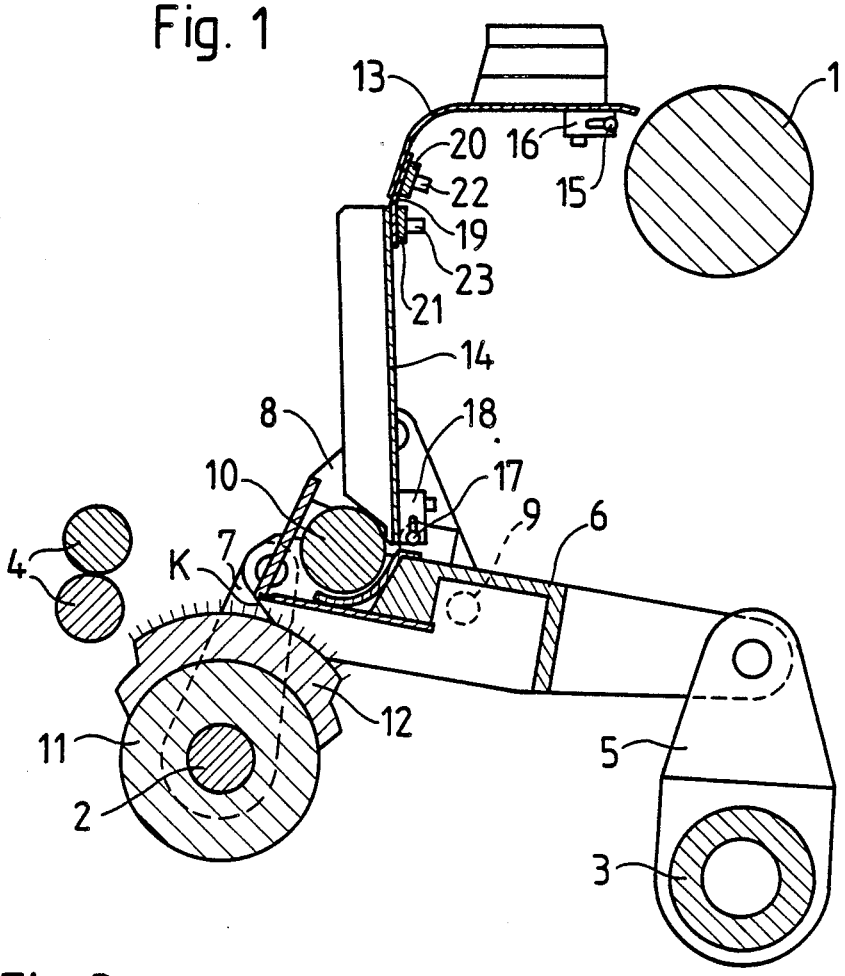
FIG. 1 illustrates a cross sectional view of a lap guide arrangement in a combing machine in accordance with the invention.
Figure 2:
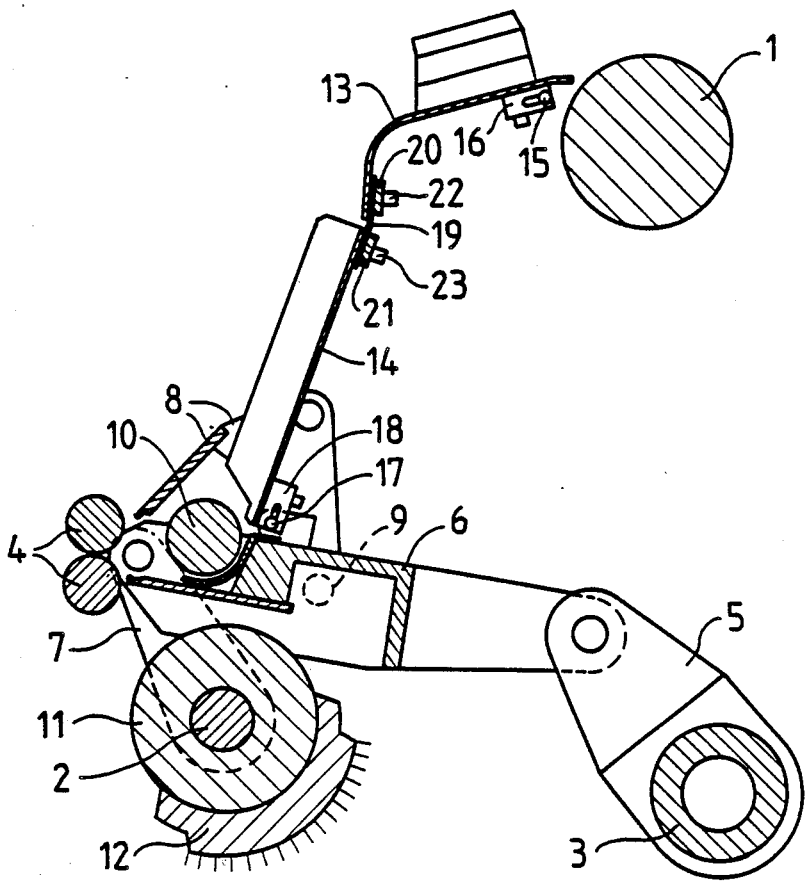
FIG. 2 illustrates a cross sectional view of the lap guide arrangement in a delivery position of the nipper.

Referring to FIG. 1, the combing machine comprises a rotating lap roller 1, a rotating comb cylinder shaft 2, a nipper shaft 3 rotatable with an oscillating movement and two detaching rollers 4, all mounted in a machine frame (not shown). The nipper shaft 3, which reciprocates between the position shown in FIG. 1 and the position shown in FIG. 2, carries crank arms 5 on which the rear end of a lower nipper jaw 6 is articulated. The front end of the lower nippier jaw 6 is articulated on links 7 mounted to pivot about the axis of the comb cylinder shaft 2. An upper nipper jaw 8 co-operates with the lower nipper jaw 6 and is connected to the latter to pivot about a pivot 9. An intermittently rotatable feed roller 10 is mounted in the lower nipper jaw 6.

The continuously rotating comb cylinder shaft 2 conventionally carries a comb cylinder 11 with a comb cylinder segment 12 bearing combing teeth.

A lap guide arrangement formed by a pair of guide plates 13, 14 is disposed between the lap roller 1 and the feed roller 10 to guide the lap.

During operation the lap for combing, which has a width of about 30 centimeters (cm) for example, lies (not shown) on the lap roller 1. Rotation of the lap roller 1 causes the lap to be unwound and fed to the first guide plate 13. The lap then passes over the first guide plate 13 and the second guide plate 14 to the feed roller 10 and from the latter to a nip K (FIG. 1) between the upper and lower nipper jaws 6, 8.

In the withdrawn position of the lower nipper jaw 6 as shown in FIG. 1, the nipper 6, 8 is closed and the lap is nipped in the nip K. A tuft projecting from the nip K is combed out by the rotating comb cylinder segment 12 in known manner. The nipper is then advanced into the position shown in FIG. 2, the nipper jaws 6, 8 opening in these conditions. The tuft combed out by the comb cylinder segment 12 is received by the detaching rollers 4 and pulled through a top comb (not shown), which is now situated in front of the detaching rollers. The lower nipper jaw 6 then returns to the withdrawn position, and the cycle starts afresh.

The two guide plates 13 and 14 ensure that the distance covered by the lap between the lap roller 1 and the feed roller 10 always remains of the same length during the described movement of the lower nipper jaw 6 and hence of the feed roller 10.

The guide plate 13 is pivotally connected adjacent the lap roller 1 via a coupling means having an element 15 which is fixed on the frame at the lap roller 1 and a member 16 fixed on the guide plate 13. In the embodiment shown in FIGS. 1 and 2, the element 15 consists of at least one shaft while the member 16 is snapped onto the shaft 15. The element 15 fixed to the frame may, for example, be a shaft extending over the entire width of the guide plate 13, onto which shaft one or more members 16 fixed on the guide plate 13 are snapped. Alternatively, a shorter shaft 15 fixed on the frame may be disposed at each of the two side edges of the guide plate 13 and have a member 16 snapped on each of them.

Similarly, the second guide plate 14 is pivotally connected at its bottom edge by a coupling means having an element 17 disposed at the feed roller 10 and held on the lower nipper jaw and a cooperating member 18 on the guide plate 14. The element 17 may again consist, for example, of at least one shaft onto which the member 18 is snapped.

In both cases, the arrangement of the shafts 15, 17 and of the members 16, 18 snapped thereon could of course be reversed, i.e., the shafts 15 and 17 could fixed on the guide plates 13 and 14 and the members 16 and 18 could be fixed on the machine frame and the lower nipper jaw 6, respectively.

The guide plates 13, 14 are pivotally connected by means of at least one strip 19 of flexible material fixed on the two plates 13, 14 in the region of the bottom edge of the plate 13 and in the region of the adjacent top edge of the plate 14 respectively, e.g. by clamping strips 20 and 21, through which countersunk screws 22 and 23 are passed and threaded into holes in the plates 13, 14 in threaded relation.

The strip 19 is preferably a strip measuring about 3 centimeters×30 centimeters (cm) extending substantially continuously over the entire width of the plates 13, 14. The width of the strip 19 may generally advantageously be between about 2 and 5 centimeters (cm). Instead of the continuous strip, however, a plurality of separate shorter strips could be used, being distributed over the width of the plates 13, 14. The thickness of the strip 19 may be about 0.5 to 2.5 millimeters (mm), preferably 1.0 to 1.5 millimeters (mm). The bottom edge of the first guide plate 13 has a small distance of about 1 to 5 millimeters (mm), preferably 2 to 3 millimeters (mm), from the top edge of the second guide plate 14; the strip 19 can deflect freely over this distance.

The strip 19 consists of a flexible material of high tensile strength of the kind used, for example, for driving belts, e.g. of plastics or an industrial fabric, preferably a fabric of polyamide filaments, such as nylon, or aramide or para-aramide filaments, suich as "KEVLAR". A fabric of this kind may be coated with a plastics material or be present as a reinforcement in a plastics strip.

Figure 3:
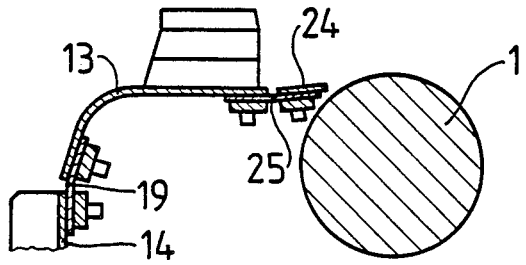
FIG. 3 illustrates a part cross sectional view of an alternative mounting of the lap guide arrangement adjacent the lap roller.

Alternatively, the coupling means the coupling the guide plates 13, 14 into the combining machine may employ at least one strip of flexible material. For example, as indicated in FIG. 3, a mounting plate 24 is fixedly mounted in the frame adjacent to the lap roller 1 and a strip 25 of flexible material is fixed to the plate 24, as above, by a clamping plate and screws as well as to the guide plate 13 in similar manner. The strip 25 of flexible material may be made of the same material as the strip 19 described above.

The invention thus provides a lap guide arrangement which is capable of flexing at a high number of nips, for example, at nip numbers of from 300 to 350. In addition, the flexible strip 19 imparts a relatively long useful life to guide arrangement.

The strip of flexible material also requires no lubrication and generates no noise during operation. This further increases the aesthetic requirements of a lap guide arrangement.

What is claimed is:

1. A lap guide arrangement for a combing machine comprising
   - a first guide plate having first means at one end for mounting on a frame adjacent a lap roller;
   - a second guide plate having second means at one end for moutning on a reciprocal nipper adjacent a feed roller; and
   - at least one strip of flexible material fixed to and between said plates to permit pivoting of said plates relative to each other.

2. A lap guide arrangement as set forth in claim 1 wherein each of said means includes at least one member secured to said respective plate for snap-fitting on a shaft.

3. A lap guide arrangement as set forth in claim 1 wherein each of said means includes at least one strip of flexible material secured to said respective plate and extending therefrom.

4. A lap guide arrangement as set forth in claim 1 wherein said strip is made of plastic.

5. A lap guide arrangement as set forth in claim 1 wherein said strip is made of a material selected from the group consisting of industrial fabric and a filament reinforced plastic fabric.

6. A lap guide arrangement as set forth in claim 5 wherein said filament reinforced plastic fabric includes filaments selected from the group consisting of polyamide filaments, aramide filaments and para-aramide filaments.

7. A lap guide arrangement as set forth in claim 6 wherein said filaments are nylon filaments.

8. A lap guide arrangement as set forth in claim 1 wherein said guide plates are spaced apart a distance of from 1 to 5 millimeters.

9. A lap guide arrangement as set forth in claim 1 where said guide plates are spaced apart a distance of from 2 to 3 millimeters.

10. A lap guide arrangement as set forth in claim 1 where said strip has a width of from 2 to 5 centimeters and a thickness of from 0.5 to 2.5 millimeters.

11. In a combing machine, the combination comprising
   - a lap roller for supplying a lap;
   - a reciprocally mounted nipper;
   - a feed roller mounted in said nipper to receive the lap; and
   - a guide arrangement for guiding the lap from said lap roller to said feed roller, said guide arrangement having a first plate pivotally mounted at one end adjacent said lap roller, a second plate pivotally mounted at one end adjacent said feed roller and at least one strip of flexible material fixed to and between said plates to permit pivoting of said plates relative to each other.

12. The combination as set forth in claim 11 wherein said strip has a high tensile strength 13. The combination as set forth in claim 12 wherein said strip is made of plastic.

14. The combination as set forth in claim 11 wherein said strip is made of a filament reinforced plastic fabric.

15. The combination as set forth in claim 14 wherein said filament reinforced plastic fabric includes filaments selected from the group consisting of polyamide filaments, aramide filaments and para-aramide filaments.

16. The combination as set forth in claim 11 which further comprises a coupling means for pivotally mounting said first plate adjacent said lap roller; said means including a shaft fixedly mounted adjacent said lap roller and a member secured to said first plate and snap-fitted onto said shaft.

17. The combination as set forth in claim 11 which further comprises a coupling means for pivotally mounting said second plate on said nipper, said means including a shaft fixedly mounted on said nipper and a member secured to said second plate and snap-fitted onto said shaft.

18. The combination as set forth in claim 11 which further comprises a coupling means for pivotally mounting said first plate adjacent said lap roller, said means including a mounting plate fixedly secured adjacent said lap roller and a flexible strip secured to and between said mounting plate and said first guide plate.

19. The combination as set forth in claim 11 wherein said first plate is of bent shape and said second plate is of flat shape to depend vertically from said first plate.

20. The combination as set forth in claim 11 which further comprises a first clamping plate at one end of said strip opposite said second plate and a plurality of screws passing through said clamping plates and said strip into threaded relation with said respective guide plates to secure said strip thereto.

* * * * *

UNITED STATES PATENT AND TRADEMARK OFFICE

CERTIFICATE OF CORRECTION

PATENT NO. : 4,928,357

DATED : May 29, 1990

INVENTOR(S) : HEINZ CLEMENT

It is certified that error appears in the above-identified patent and that said Letters Patent is hereby corrected as shown below:

In the Abstract, line 1 "arrangements" should be -arrangement-
Column 2, line 12, 13 "accompany" should be -accompanying-
Columm 2, line 30 "nippier" should be -nipper-
Column 3, line 21 "could fixed" should be -could be fixed-
Column 3, line 52 "suich" should be -such-
Column 3, line 56 "means the coupling" should be -means coupling-
Column 4, line 2 "to guide" should be -to the guide-
Column 4, line 13 "moutning" should be -mounting-

Signed and Sealed this

Fifteenth Day of October, 1991

*Attest:*

HARRY F. MANBECK, JR.

*Attesting Officer*

*Commissioner of Patents and Trademarks*